US010590626B2

(12) United States Patent
Iwamoto et al.

(10) Patent No.: US 10,590,626 B2
(45) Date of Patent: Mar. 17, 2020

(54) COUNTERWEIGHT SUPPORTING STRUCTURE FOR CONSTRUCTION MACHINE

(71) Applicant: Caterpillar SARL, Geneva (CH)

(72) Inventors: Takahiro Iwamoto, Tokyo (JP); Kentaro Nakayama, Tokyo (JP); Takeshi Tsuneyoshi, Tokyo (JP)

(73) Assignee: Caterpillar SARL, Geneva (CH)

( * ) Notice: Subject to any disclaimer, the term of this patent is extended or adjusted under 35 U.S.C. 154(b) by 100 days.

(21) Appl. No.: 15/737,272

(22) PCT Filed: Jun. 14, 2016

(86) PCT No.: PCT/EP2016/063659
§ 371 (c)(1),
(2) Date: Dec. 15, 2017

(87) PCT Pub. No.: WO2016/202812
PCT Pub. Date: Dec. 22, 2016

(65) Prior Publication Data

US 2018/0195253 A1 Jul. 12, 2018

(30) Foreign Application Priority Data

Jun. 18, 2015 (JP) ..... 2015-122740

(51) Int. Cl.
*E02F 9/18* (2006.01)
*E02F 3/30* (2006.01)
*E02F 9/12* (2006.01)

(52) U.S. Cl.
CPC ..... *E02F 9/18* (2013.01); *E02F 3/30* (2013.01); *E02F 9/12* (2013.01)

(58) Field of Classification Search
CPC ..... E02F 9/18; E02F 9/12; E02F 3/30; E02F 9/08; B66F 9/07554; B62D 49/085
See application file for complete search history.

(56) References Cited

U.S. PATENT DOCUMENTS 2,264,512 A * 12/1941 Dunham ..... B66F 9/07513 414/635
2,331,734 A * 10/1943 Schroeder ..... B66F 9/07554 180/65.1
3,023,024 A * 2/1962 McAdams ..... B62D 49/085 280/759
3,061,034 A * 10/1962 Hoyt ..... B62D 49/085 180/68.5

(Continued)

FOREIGN PATENT DOCUMENTS

JP H09-209407 A 8/1997
JP 2001-032328 A 2/2001

(Continued)

*Primary Examiner* — Paul N Dickson
*Assistant Examiner* — Timothy Wilhelm

(57) ABSTRACT

To improve the precision of position of a fastener hole and a seating face for mounting a counterweight, a counterweight supporting member is comprised of a support plate erected and fixed at the rear end of a revolving frame and a supporting member attached to the support plate. A cylindrical bolt fastening boss is provided on the supporting member in a manner of rotational position adjustable to the supporting plate and in which a fastener hole is formed at an eccentric position.

9 Claims, 14 Drawing Sheets

(56) References Cited

U.S. PATENT DOCUMENTS 3,142,915 A * 8/1964 Curlett ..... E02F 3/841 172/26
3,217,825 A * 11/1965 Hauxwell ..... B60K 1/04 180/311
3,367,441 A * 2/1968 Schuster ..... B60K 1/04 180/68.5
3,533,524 A * 10/1970 Wilcox ..... E02F 9/18 414/694
3,687,484 A * 8/1972 Cosby ..... B60K 1/04 280/755
3,709,520 A * 1/1973 Johnson ..... B62D 49/085 280/759
3,730,545 A * 5/1973 Allori ..... B62D 49/0628 280/759
3,763,946 A * 10/1973 Termont ..... B60B 15/28 180/9.62
3,795,330 A * 3/1974 Jorgensen ..... E02F 9/18 414/719
3,888,507 A * 6/1975 Berghausen ..... B60D 1/02 280/759
3,891,095 A * 6/1975 Symmank ..... B66C 23/74 212/178
3,935,921 A * 2/1976 Muller ..... B60K 5/00 180/89.1
4,029,340 A * 6/1977 Chelin ..... B60D 1/00 280/759
4,067,415 A * 1/1978 Samide ..... B62D 49/085 187/222
4,077,142 A * 3/1978 Klett ..... E02F 3/8152 172/701.3
4,094,534 A * 6/1978 Welke ..... B62D 49/085 280/759
4,402,413 A * 9/1983 Sickler ..... E02F 9/18 212/178
4,580,650 A * 4/1986 Matsuda ..... B66F 9/06 180/326
5,141,195 A * 8/1992 Toda ..... B66C 23/74 212/178
5,779,260 A * 7/1998 Reilly ..... B60G 15/07 280/86.754
5,833,268 A * 11/1998 Aldrovandi ..... B60R 9/00 280/759
5,845,940 A * 12/1998 Colburn ..... B60K 15/067 280/830
7,036,251 B2 * 5/2006 Kojima ..... E02F 9/18 37/466
7,077,411 B2 * 7/2006 Peters ..... B60G 5/02 280/124.132
7,475,466 B2 * 1/2009 Marume ..... B25B 27/0035 29/281.5
7,669,898 B2 * 3/2010 Hamaguchi ..... B66C 23/74 280/759
7,681,556 B2 * 3/2010 Hwang ..... E02F 9/00 123/510
7,806,214 B2 * 10/2010 Tsukui ..... B62D 21/186 180/89.17
8,434,787 B2 * 5/2013 Halepatali ..... E02F 3/627 212/178
8,695,827 B2 * 4/2014 Klauer ..... B60K 13/04 141/369
8,979,125 B2 * 3/2015 Sato ..... E02F 9/0866 280/759
9,045,002 B2 * 6/2015 Wada ..... B60B 35/02
9,074,342 B2 * 7/2015 Kitatani ..... E02F 9/18
9,169,622 B2 * 10/2015 Sho ..... E02F 9/18
9,216,698 B2 * 12/2015 Rhodes ..... B60R 9/065
9,255,382 B2 * 2/2016 Noda ..... E02F 9/16
9,366,007 B2 * 6/2016 Azuma ..... E02F 9/0833
9,556,585 B2 * 1/2017 Doi ..... E02F 9/18
9,574,323 B2 * 2/2017 Hashimoto ..... E02F 9/18
9,623,918 B2 * 4/2017 Fukatsu ..... B62D 49/085
9,663,919 B2 * 5/2017 Hwang ..... E02F 3/32
9,745,718 B2 * 8/2017 Mochimaru ..... E02F 9/18
10,005,494 B2 * 6/2018 Fink ..... B62D 17/00
10,036,136 B2 * 7/2018 Higuchi ..... E02F 3/325
10,046,957 B2 * 8/2018 Fukatsu ..... B62D 49/085
10,167,612 B2 * 1/2019 Kohzu ..... E02F 9/18
10,174,480 B2 * 1/2019 Tanaka ..... E02F 9/18
10,183,705 B2 * 1/2019 Narahara ..... B62D 27/04
10,267,017 B2 * 4/2019 Setaki ..... E02F 3/325
10,301,797 B2 * 5/2019 Iwamoto ..... E02F 3/304
10,323,557 B2 * 6/2019 Kubota ..... F01N 3/2066
2003/0056404 A1 * 3/2003 Iwasa ..... E02F 9/0866 37/347
2004/0200100 A1 * 10/2004 Kojima ..... E02F 9/18 37/348
2012/0067660 A1 * 3/2012 Kashu ..... B60K 13/04 180/296
2012/0187721 A1 * 7/2012 Nishimura ..... E02F 9/16 296/190.03
2013/0071295 A1 * 3/2013 Terakawa ..... E02F 9/0858 422/168
2015/0139768 A1 * 5/2015 Egawa ..... E02F 9/18 414/719
2017/0210432 A1 * 7/2017 Cartechini ..... B62D 49/085
2018/0044150 A1 * 2/2018 Mori ..... E02F 9/18
2018/0079632 A1 * 3/2018 Plachta ..... B66F 9/07513
2018/0171589 A1 * 6/2018 Iwamoto ..... E02F 3/304
2018/0274423 A1 * 9/2018 Kubota ..... F01P 1/06

FOREIGN PATENT DOCUMENTS

KR 2010-0020567 A 2/2010
KR 2010-0091443 A 8/2010
KR 2011-0045364 A 5/2011

* cited by examiner (A)

(B)

(A)

(B)

(A)

(B)

(A)

(B)

COUNTERWEIGHT SUPPORTING STRUCTURE FOR CONSTRUCTION MACHINE

CROSS-REFERENCE TO RELATED APPLICATIONS

This applications is a national phase application of International Patent Application No. PCT/EP2016/063659 filed Jun. 14, 2016, which claims priority to Japanese Patent Application No. 2015- 122740 filed Jun. 18, 2015, both of which are incorporated by reference herein in their entireties for all purposes.

TECHNICAL FIELD

The present invention relates to the technical field of a counterweight supporting structure for a construction machine such as a hydraulic shovel.

BACKGROUND ART

Some construction machines have a counterweight for ensuring the balance of the machine body. These construction machines are generally known to have a configuration in which the counterweight, when mounted on the machine body, is supported by a counterweight support through fastening bolts, the counterweight support being provided in the rear portion of the vehicle body frame. For instance, in a hydraulic shovel, an example of a construction machine, the counterweight support is provided in the rear portion of the vehicle body frame (slewing frame) configuring the base of an upper slewing body, wherein the counterweight is supported by the counterweight support through fastening bolts fastened thereto. In such a construction machine, the counterweight support has a counterweight mounting seat surface that is integrally fixed by adhesion or the like to the rear portion of the vehicle body frame to configure a part of the vehicle body frame and comes into surface-contact with the counterweight, wherein the counterweight mounting seat surface is sometimes machined to ensure a flat surface or to form fastener holes (screw holes) for the fastening bolts by using machine tools.

Incidentally, many of the construction machines are large vehicles, and the larger the vehicle sizes, the more difficult it is to machine the counterweight mounting seat surface after the completion of the assembly of the vehicle body frame, because of the size of the machine tools. Therefore, a counterweight support in which the counterweight mounting seat surface has already been machined beforehand is welded to form the vehicle body frame. In this case, however, the counterweight support might become shifted from a predetermined regular position thereof due to welding stress or the like that occurs upon the assembly of the vehicle body frame, resulting in shifting of the counterweight mounting seat surface and fastener holes from their regular positions. Especially when the reference for positioning is set at the front side of the vehicle body frame or a slewing bearing portion, the counterweight support located on the rear end side of the vehicle body frame is displaced significantly due to the accumulation of welding stress. This makes it difficult to attach the counterweight and generates a gap or level difference between the counterweight and a vehicle body cover or a skirt channel disposed in front of the counterweight, because the counterweight is attached with the counterweight support being displaced, resulting in damaging the appearance.

There have conventionally been known a technique for configuring the counterweight support by using a vertical plate extending from the vehicle body frame, a back plate and a bottom plate adhered respectively to upper and lower end surfaces of the vertical plate, and a pipe member that is capable of sliding vertically between the back plate and the bottom plate and has a counterweight mounting seat surface (counterweight supporting surface) on its upper surface, wherein the pipe member is adhered to a back plate and the bottom plate after the back plate and the bottom plate are adhered to the vertical plate, and a technique for adhering the back plate to the vertical plate extending from the vehicle body frame and thereafter adhering a block having a counterweight mounting seat surface on its upper surface to a cutout portion of the back plate.

Furthermore, there has also been known a technique for forming a boss fitting hole in the rear portion of the vehicle body frame, forming a boss capable of coming into engagement with the boss fitting hole in a front surface of the counterweight, and attaching the counterweight to the vehicle body frame by fastening a bolt passing through the boss, wherein the boss fitting hole is shaped into an oval having the horizontal length greater than the vertical length, and the boss fitting position in the boss fitting hole can be displaced/adjusted by a small amount in the lateral direction.

SUMMARY

[The present invention was contrived in view of the foregoing circumstances and for the purpose of solving these problems. ]The invention described is a counterweight supporting structure for a construction machine having a counterweight, wherein, in order to support the counterweight on a counterweight support provided in a rear portion of a vehicle body frame by using a fastening bolt, the counterweight support is configured using a support plate that is fixed upright to the rear portion of the vehicle body frame, and a support member which is attached to the support plate fixed to the vehicle body frame in such a manner that a longitudinal position of the support member is adjustable and which has a counterweight mounting seat surface that comes into abutment with the counterweight and a fastener hole to which the fastening bolt is fastened, the support member being configured with a cylindrical bolt fastening boss that has a rotation position thereof adjustable with respect to the support plate and has the fastener hole formed in a position off from an axial center position.

[The invention described in claim 2 is, according to claim 1, a counterweight supporting structure for a construction machine, wherein the support member is configured with a base member that is fitted and fixed to the support plate in such a manner that a longitudinal position and a lateral or vertical position thereof are adjustable, and has the counterweight mounting seat surface, and a cylindrical bolt fastening boss that is fitted and fixed to a circular boss hole opened in the base member in such a manner that a rotation position of the bolt fastening boss is adjustable, and has a fastener hole formed in a position off from the axial center position.]

[The invention described in claim 3 is, according to claim 2, a counterweight supporting structure for a construction machine, wherein the base member is fixed to the support plate in such a manner that inclination thereof with respect to the support plate is adjustable.]

[The invention described in claim 4 is, according to claim 1, a counterweight supporting structure for a construction machine, wherein the support member is configured using a cylindrical bolt fastening boss that is fitted and fixed to a circular boss hole opened in the support plate, in such a manner that the longitudinal position and rotation position of the bolt fastening boss are adjustable, and has a counterweight mounting seat surface, the bolt fastening boss having a plurality of fastener holes, eccentric distances from which to the axial center position are mutually different.]

[The invention described in claim 5 is, according to claim 4, a counterweight supporting structure for a construction machine, wherein the bolt fastening boss is fitted and fixed to the boss hole opened in the support plate, in such a manner that inclination thereof with respect to the support plate is adjustable.]

According to the invention, the positional accuracy of the counterweight mounting seat surface and of the fastener hole can reliably be improved.

[According to the invention described in claim 2, the support base can be configured using the base member and the bolt fastening boss.]

[According to the invention described in claim 3, not]Not only is it possible to ensure the perpendicularity of the base member with respect to the horizontal reference of the machine body, but also the flatness of the mounting seat surface can be ensured without performing any machining, by adjusting the inclination of the base member with respect to the support plate.

[According to the invention described in claim 4, the support member can be configured using the bolt fastening boss that has a plurality of fastener holes in eccentric positions.]

[According to the invention described in claim 5, not only is it possible to ensure the perpendicularity of the base member with respect to the horizontal reference of the machine body, but also the flatness of the mounting seat surface can be ensured without performing any machining, by adjusting the inclination of the bolt fastening boss with respect to the support plate.]

DESCRIPTION OF EMBODIMENTS

Figure 1:
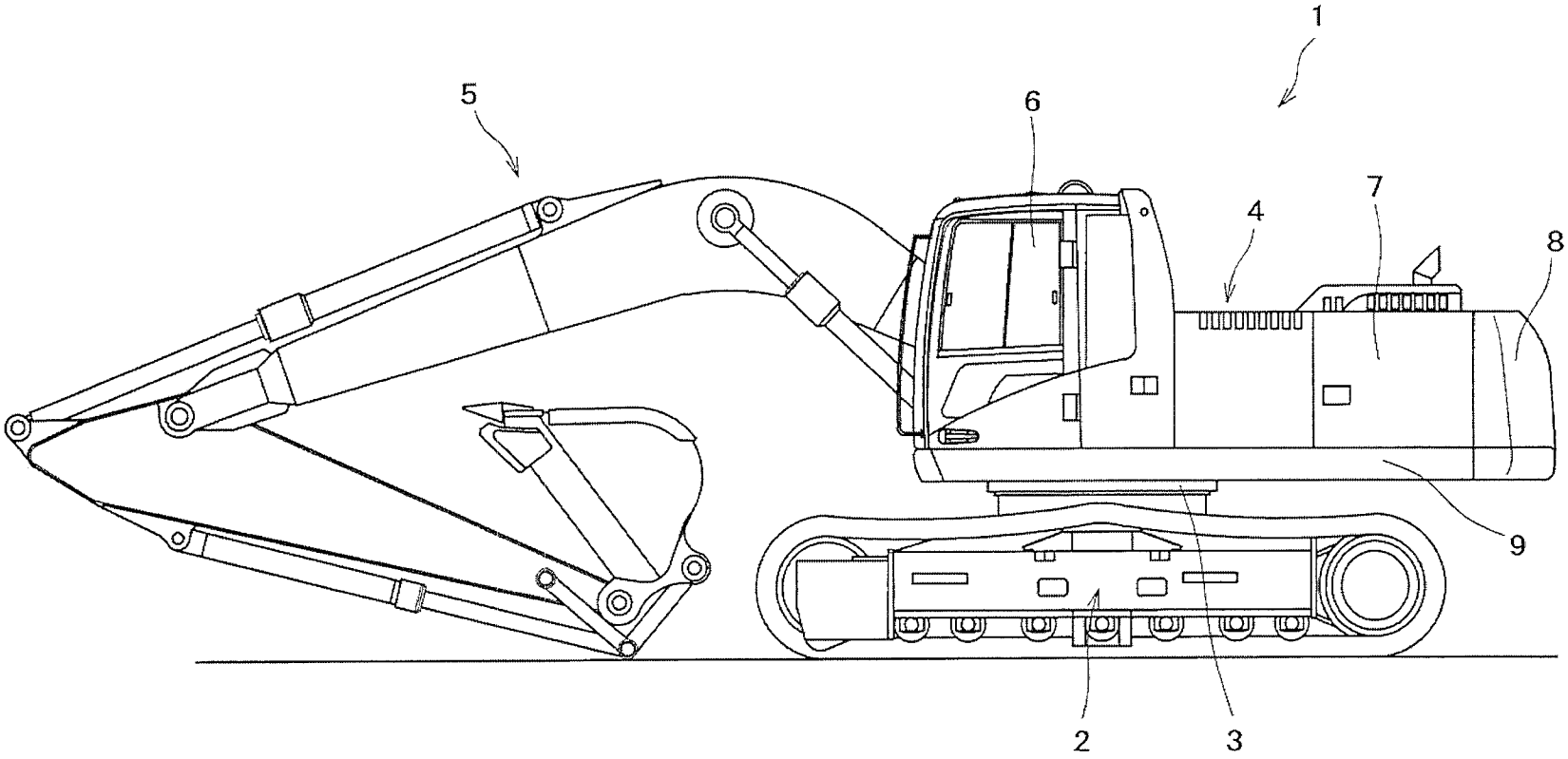
FIG. 1 is a side view of a hydraulic shovel.
Figure 2:
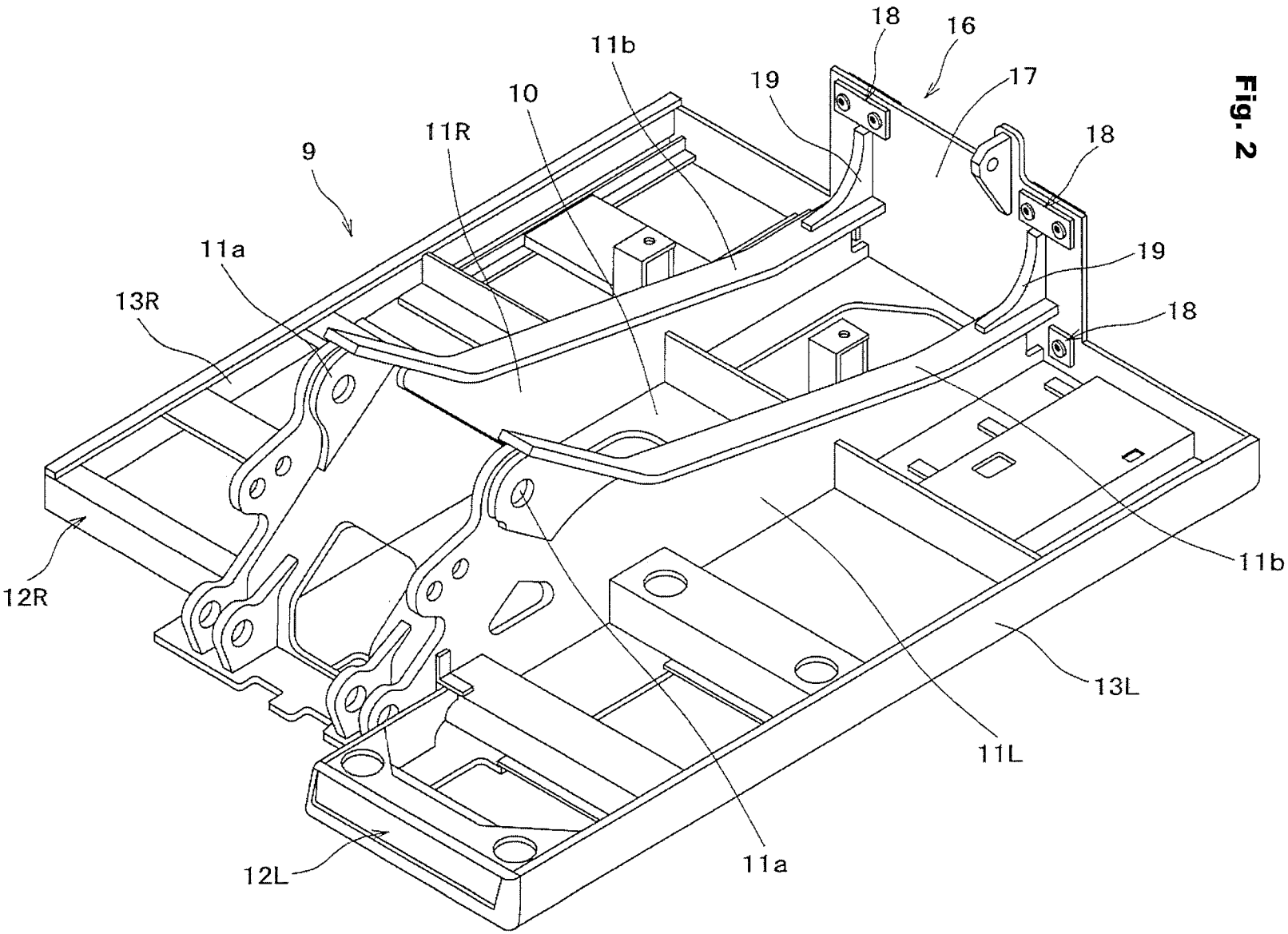
FIG. 2 is a perspective view of a slewing frame according to a first embodiment.
Figure 3:
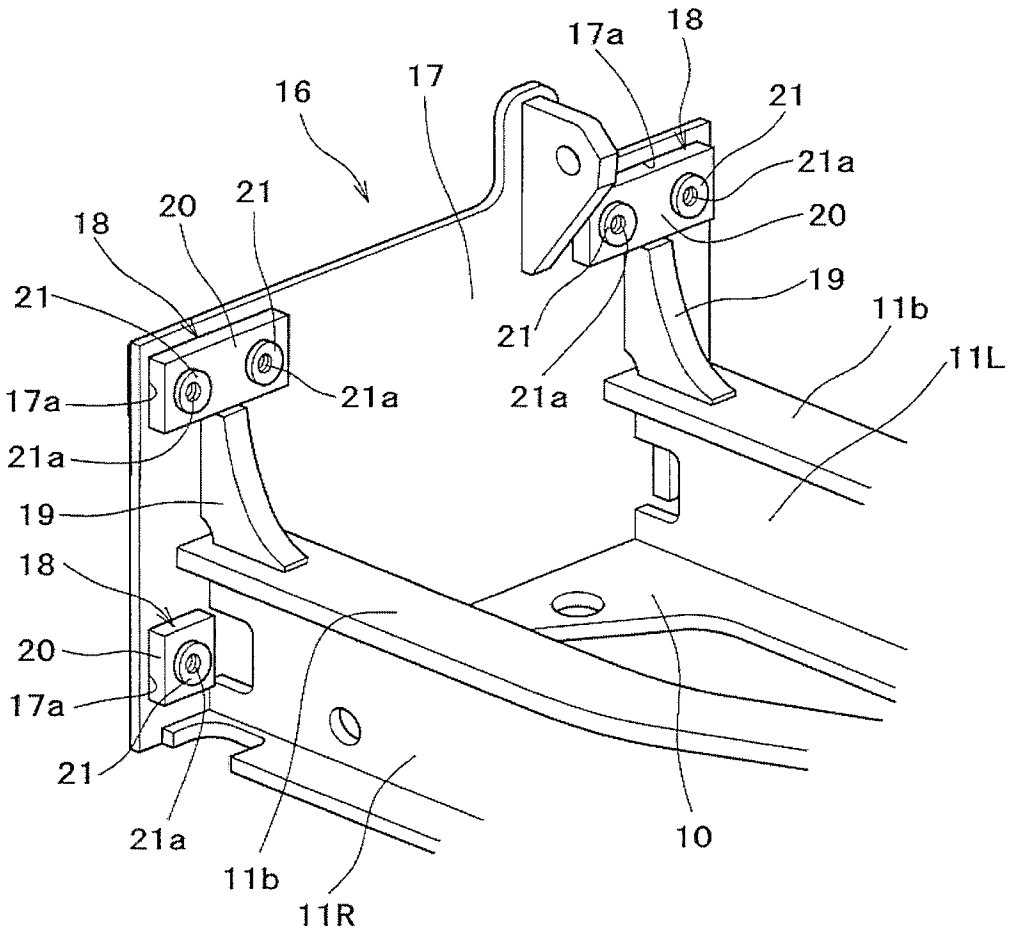
FIG. 3 is a perspective view of a counterweight support according to the first embodiment, viewed from the front.
Figure 4:
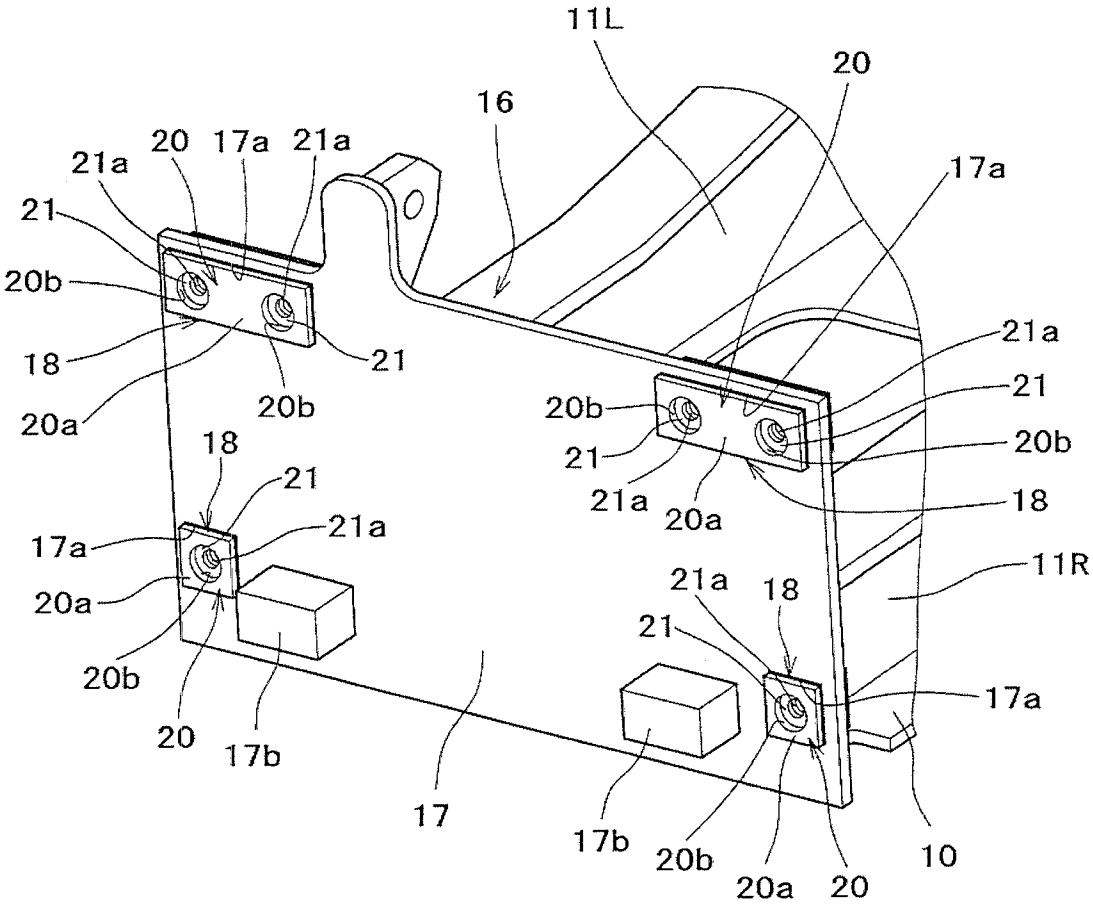
FIG. 4 is a perspective view of the counterweight support according to the first embodiment, viewed from the rear.
Figure 5:
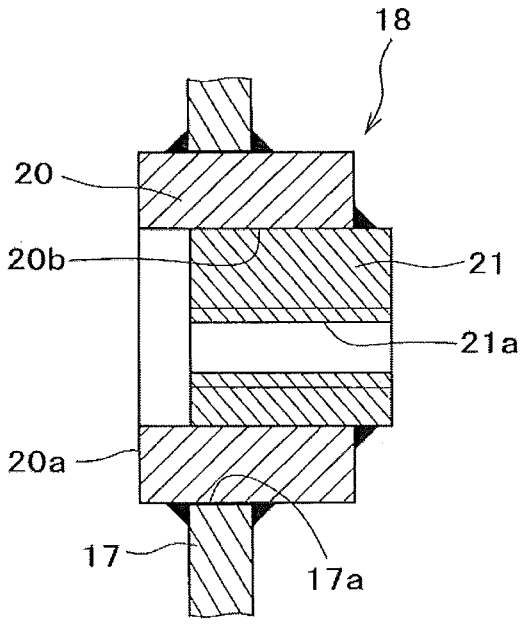
FIG. 5(A) is a cross-sectional view showing substantial parts of the counterweight support according to the first embodiment.
FIG. 5(B) is a cross-sectional view of the counterweight support to which is attached a counterweight according to the first embodiment.
Figure 5:
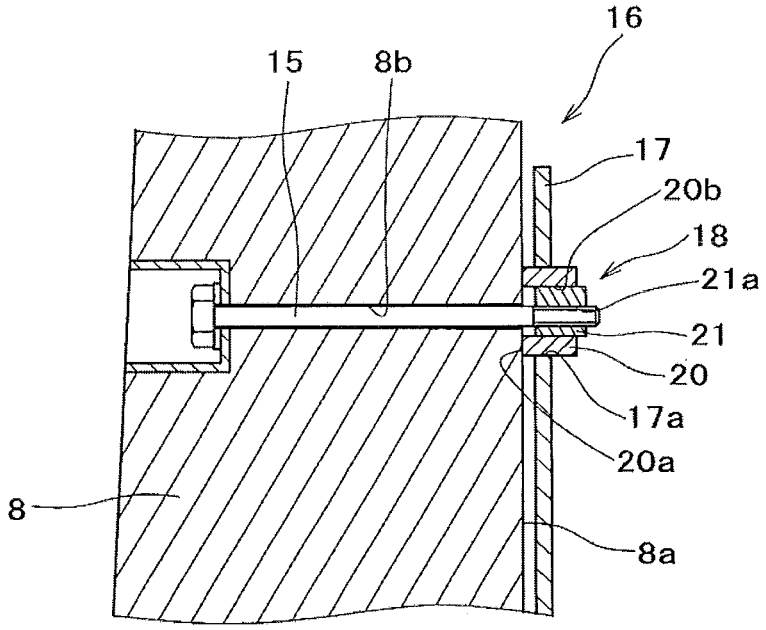
Figure 6:
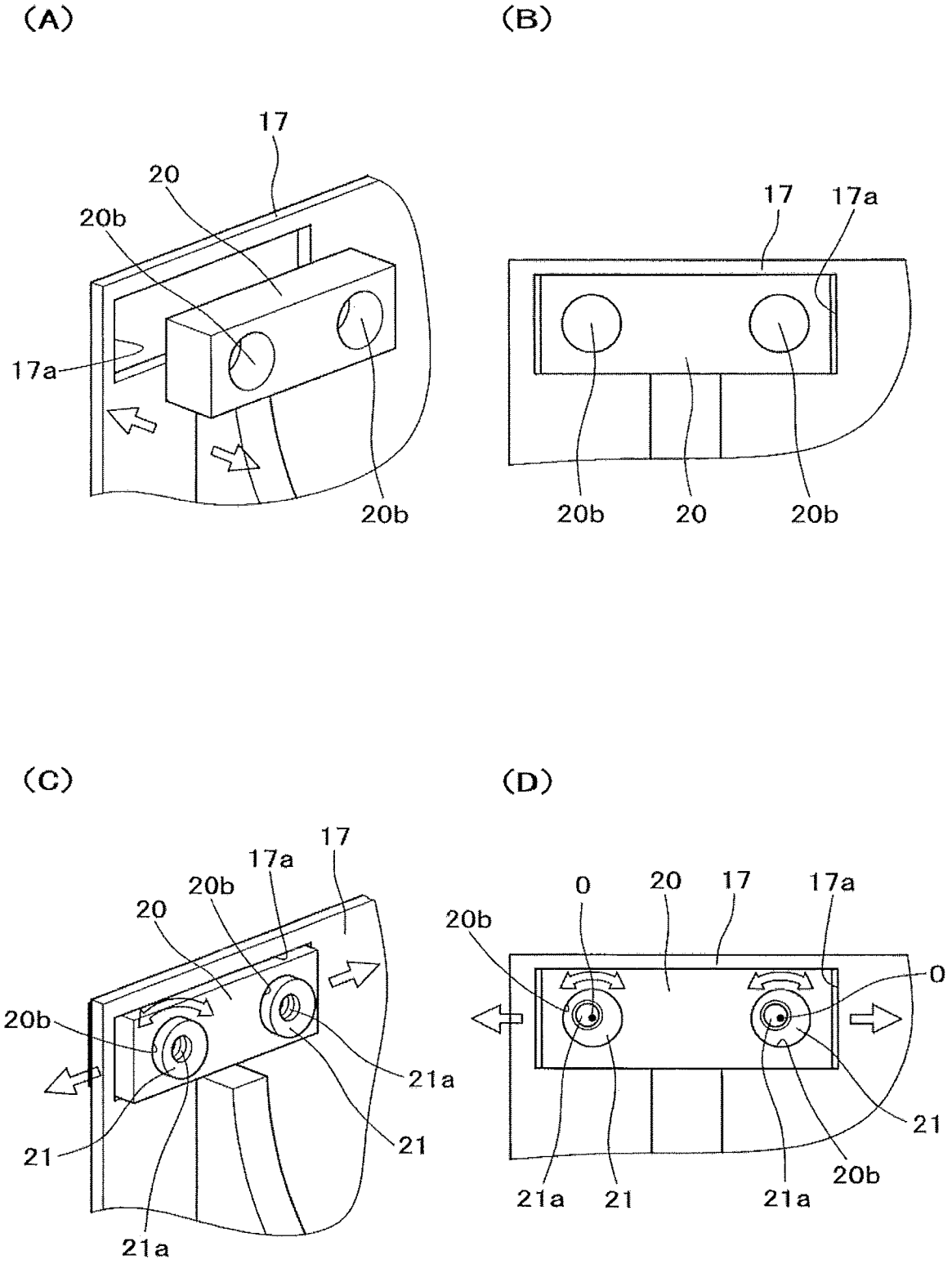
FIGS. 6(A), 6(B), 6(C) and 6(D) are each a diagram showing how the support member according to the first embodiment is attached.

Embodiments of the present invention are now described hereinafter with reference to the drawings.

First of all, the first embodiment is described with reference to FIGS. 1 to 6. In the diagrams, reference numeral 1 represents a hydraulic shovel, an example of a construction machine. The hydraulic shovel 1 is configured with parts such as a crawler-type lower traveling body 2, an upper slewing body 4 supported in a slewable manner by the lower traveling body 2 through a slewing bearing 3, and a front working unit 5 installed on the upper slewing body 4. The upper slewing body 4 is provided with an operator's cab 6 and an engine room 7, and a rear end portion of the upper slewing body 4 is provided with a counterweight 8 for balancing the load with respect to the front working unit 5.

Reference numeral 9 represents a slewing frame configuring the base of the upper slewing body 4 (corresponding to a vehicle body frame according to the present invention). The slewing frame 9 is configured with various frame materials such as a bottom surface plate 10 to which the slewing bearing 3 is attached, left and right main frames 11L, 11R taken in pairs that are provided upright on the bottom surface plate 10, have a working unit mounting seat 11*a* axially supporting a base end portion of the front working unit 5, and extend in the longitudinal direction, left and right side frames 12L, 12R provided on the outside of the left and right main frames 11L, 11R and having various pieces of equipment such as the operator's cab 6 and the engine (not shown) mounted therein, and left and right skirt channels 13L, 13R provided on the outer end portions of the left and right side frames 12L, 12R and extending in the longitudinal direction. These frame materials are welded integrally. A counterweight support 16 for supporting the counterweight 8 using fastening bolts 15 is provided at the rear portion of the slewing frame 9.

The counterweight support 16 is configured using a support plate 17, described hereinafter, which is fixed upright at the rear portion of the slewing frame 9, and support members 18, described hereinafter, which are attached to the support plate 17, brought into abutment with a front surface 8*a* of the counterweight 8, and have the fastening bolts 15 fastened thereto.

The support plate 17, one of the frame materials configuring the slewing frame 9, is integrally fixed by welding to the rear end portions of the left and right main frames 11L, 11R and of the bottom surface plate 10, with the surface of the support plate 17 being oriented vertically so as to face the front surface 8*a* of the counterweight 8 supported by the counterweight support 16. Rectangular through-holes 17*a* are opened at a total of four portions of the support plate 17, i.e., the upper left portion, the upper right portion, the lower left portion, and the lower right portion. The support members 18 are attached to these through-holes 17*a*. In the diagram, reference numeral 19 represents a reinforcing plate that is adhered to each of the corners formed between the support plate 17 and upper surfaces 11*b* of the left and right main frames 11L, 11R. Reference numeral 17*b* represents a projection that is formed on the rear surface of the support plate 17 (the surface facing the front surface 8*a* of the counterweight 8) and comes into engagement with a depression (not shown) formed in a lower portion of the front surface 8*a* of the counterweight 8.

The support members 18 are each configured using a base member 20, described hereinafter, which is attached to the support plate 17 fixed to the slewing frame 9, after the assembly of the slewing frame 9, fitted and fixed to the corresponding through-hole 17*a* of the support plate 17 in such a manner that the longitudinal position and the lateral position of the base member 20 are adjustable, and has a counterweight mounting seat surface 20*a*, and a bolt fastening boss 21, described hereinafter, which is fitted and fixed to a circular boss hole 20*b* opened in the base member 20 in such a manner that the rotation position of the bolt fastening boss 21 is adjustable, and has a fastener hole (screw hole) 21*a* at an eccentric position.

The base members 20 are in the shape of a rectangular block so as to be fitted to the respective rectangular through-holes 17*a* opened in the support plate 17. The thickness of each base member 20 in the longitudinal direction is set to be greater than the thickness of the support plate 17 in the longitudinal direction and the base members 20 can be moved in the longitudinal direction by the difference between the thicknesses excluding the weld leg length. Furthermore, the lateral width of each of the through-holes 17*a* of the support plate 17 is set to be greater than the lateral width of each base member 20, and the base members 20 can be moved in the lateral direction by the difference between the lateral widths. The base members 20 are fitted into the through-holes 17*a* in such a manner that the rear surfaces of the base members 20 (the surfaces facing the front surface 8*a* of the counterweight 8) project farther than the rear surface of the support plate 17, wherein the rear surfaces of the base members 20 configure the counterweight mounting seat surfaces 20*a*, with which the front surface 8*a* of the counterweight 8 comes into surface-contact. Moreover, circular boss holes 20*b* into which the bolt fastening bosses 21 are fitted are punched in the respective base members 20. In the present embodiment, left and right boss holes 20*b* taken in pairs are punched in the base members 20 of the respective support members 18 attached to the upper left and upper right through-holes 17*a* of the support plate 17. Also, a single boss hole 20*b* is punched in the center of each of the base members 20 of the respective support members 18 attached to the lower left and lower right through-holes 17*a*.

The bolt fastening bosses 21 are in the shape of a cylindrical block and fitted into the boss holes 20*b* of the base members 20 in such a manner as to be rotatable about the axial center. The fastener holes 21*a* to which the fastening bolts 15 are fastened are punched in the positions in the bolt fastening bosses 21 that are off from the axial center position O. The bolt fastening bosses 21 are fitted into the boss holes 20*b*, with the rear surfaces of the bolt fastening bosses 21 being sunk inward of the rear surfaces of the base members 20 (the counterweight mounting seat surfaces 20*a*) and with the front surfaces of the same protrude from the front surfaces of the base members 20. By rotating the bolt fastening bosses 21 fitted into the boss holes 20*b* about the respective axial centers, the vertical positions and the lateral positions of the fastener holes 21*a* formed in the bolt fastening bosses 21 can be changed.

In order to attach the base members 20 and the bolt fastening bosses 21 to the support plate 17, first the base members 20 are fitted into the through-holes 17*a* of the support plate 17, in which state the base members 20 are moved in the longitudinal direction so that the longitudinal positions of the counterweight mounting seat surfaces 20*a* are adjusted to predetermined regular positions. Furthermore, while having the bolt fastening bosses 21 fitted into the boss holes 20*b* of the base members 20, the vertical positions of the fastener holes 21*a* are adjusted to predetermined regular positions by rotating the bolt fastening bosses 21, and the lateral positions of the fastener holes 21*a* are adjusted to predetermined regular positions by moving the base members 20 left and right. The base members 20 having their longitudinal positions and lateral positions adjusted, are fixed by welding to the through-holes 17*a* of the support plate 17, and the bolt fastening bosses 21 having their rotation positions adjusted, are fixed by welding to the boss holes 20*b* of the base members 20.

Then, after assembling the slewing frame 9, the counterweight support 16 is formed by fixing the base members 20 and the bolt fastening bosses 21 to the support plate 17 configuring the slewing frame 9. In this case, the longitudinal positions of the counterweight mounting seat surfaces 20*a* can be positioned to the regular positions by adjusting the longitudinal positions of the base members 20, and the vertical and lateral positions of the fastener holes 21*a* can be positioned to the regular positions by adjusting the rotation positions of the bolt fastening bosses 21 and the lateral positions of the base members 20.

On the other hand, the counterweight 8 is provided with bolt insertion holes 8*b* that have the fastening bolts 15 inserted therethrough and penetrate from the front to the rear of the counterweight 8. When supporting the counterweight 8 using the counterweight support 16, the fastening bolts 15, which are inserted into the bolt insertion holes 8*b* from the rear side of the counterweight 8, are threaded and fastened to the fastener holes 21*a* of the bolt fastening bosses 21, while having the front surface 8*a* of the counterweight 8 in surface-contact with the counterweight mounting seat surfaces 20*a* of the base members 20. In this manner, the counterweight 8 is supported by the counterweight support 16. In this case, however, the positions of the counterweight mounting seat surfaces 20*a* and the fastener holes 21*a* are adjusted to the regular positions, whereby the counterweight 8 can be attached to the regular position.

In the first embodiment that is configured as described above, the counterweight 8 is supported by the counterweight support 16 in the rear portion of the slewing frame 9 through the fastening bolts 15, wherein the counterweight support 16 is configured using the support plate 17 fixed upright to the rear portion of the slewing frame 9, and the support members 18 that are attached to the support plate 17 fixed to the slewing frame 9 and have the fastener holes 21*a* to which are fastened the counterweight mounting seat surfaces 20*a* that comes into abutment with the counterweight 8 and the fastening bolts 15. The support members 18 are configured using the base members 20 with the counterweight mounting seat surfaces 20*a*, which are fitted and fixed to the through-holes 17*a* opened in the support plate 17, in such a manner that the longitudinal positions and the lateral positions of the base members 20 are adjustable, and the cylindrical bolt fastening bosses 21 that are fitted and fixed to the circular boss holes 20*b* opened in the base members 20 in such a manner that the rotation positions of the bolt fastening bosses 21 are adjustable, and have the fastener holes 21*a* formed in the positions that are off from the axial center positions O.

According to the present embodiment, as described above, when the support members 18 are attached to the support plate 17 fixed to the slewing frame 9, the support members 18 can be attached in view of displacement of the support plate 17 caused by welding stress or the like occurring during the assembly of the slewing frame 9. In this case, the support members 18 are configured with the base members 20 with the counterweight mounting seat surfaces 20*a*, the longitudinal positions and the lateral positions of which are adjustable with respect to the support plate 17, and the cylindrical bolt fastening bosses 21 that have the rotation positions thereof adjustable with respect to the base members 20 and have the fastener holes 21*a* formed in the eccentric positions. Then, the longitudinal positions of the counterweight mounting seat surfaces 20*a* can be adjusted by adjusting the longitudinal positions of the base members 20, and the vertical and lateral positions of the fastener holes 21*a* can be adjusted by adjusting the rotation positions of the bolt fastening bosses 21 and the lateral positions of the base members 20, significantly improving the positional accuracy of the counterweight mounting seat surfaces 20*a* and of the fastener holes 21*a*. Consequently, not only is it possible to perform the work on attaching the counterweight 8 accurately, but it is possible to reliably prevent the appearance of the configuration from being ruined by a gap or level difference that can be generated between the counterweight 8 and the cover body covering the engine room 7 or the skirt channels 13L, 13R due to displacement of the counterweight mounting seat surfaces 20*a* or fastener holes 21*a*.

It goes without saying that the present invention is not limited to the first embodiment. According to the first embodiment, the lateral width of the through-holes 17*a* of the support plate 17 is set to be greater than the lateral width of the base members 20, wherein the base members 20 can be moved in the lateral direction by the difference between the lateral widths, and the vertical positions of the fastener holes 21*a* can be adjusted by the rotation of the bolt fastening bosses 21 while the lateral positions of the fastener holes 21*a* are adjusted by moving the base members 20 left and right. However, according to a second embodiment shown in FIG. 7(A), the vertical width of the through-holes 17*a* of the support plate 17 is set to be greater than the vertical width of the base members 20, wherein the base members 20 can be moved in the vertical direction by the difference between the vertical widths. In such a case, the vertical positions of the fastener holes 21*a* are adjusted by moving the base members 20 in the longitudinal direction, and the lateral positions of the fastener holes 21*a* are adjusted by the rotation of the bolt fastening bosses 21. The second embodiment is the same as the first embodiment except for the size of the through-holes 17*a* of the support plate 17, and the components of the second embodiment same as those of the first embodiment are given the same reference numerals.

Figure 7:
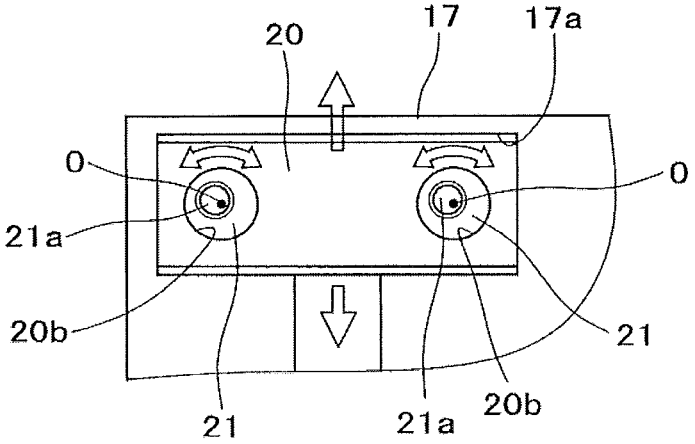
FIG. 7(A) is a diagram showing how a support member according to a second embodiment is attached.
FIG. 7(B) is a cross-sectional view showing how a base member according to a third embodiment is attached.
Figure 7:
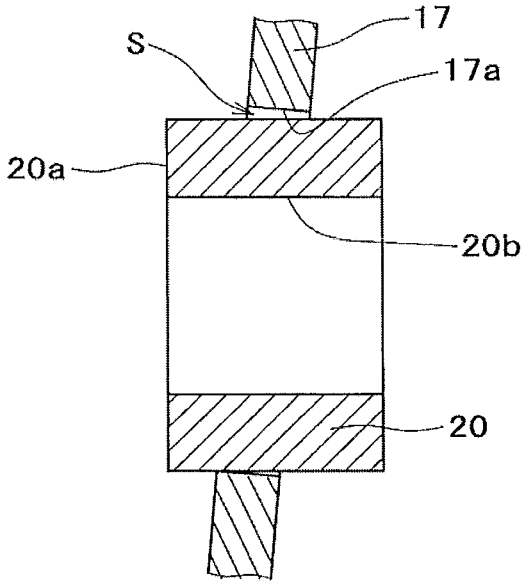

According to a third embodiment shown in FIG. 7(B), a space S for adjusting the inclination of each base member 20 with respect to the support plate 17 is formed between the corresponding through-hole 17*a* opened in the support plate 17 and the base member 20 fitted into the through-hole 17*a*, prior to fixing the base member 20 to the through-hole 17*a*. While having the inclination of the base member 20 adjusted in such a manner that the counterweight mounting seat surface 20*a* thereof becomes parallel to the front surface 8*a* of the counterweight 8 at the regular position, the base member 20 is fixed to the support plate 17 by welding, and thereby the space S is filled as a result of this welding. By fixing the base member 20 to the support plate 17 in such a manner that the inclination of the base member 20 is adjustable with respect to the support plate 17, the inclination of the base member 20 can be adjusted in such a manner that the counterweight mounting seat surface 20*a* thereof becomes parallel to the front surface 8*a* of the counterweight 8 in the regular position, even when the support plate 17 is fixed to the slewing frame 9 while being inclined in the longitudinal, vertical, and lateral directions due to welding stress or the like. Thus, not only is it possible to ensure perpendicularity of the base member 20 with respect to the horizontal reference of the machine body (vehicle body frame), but also the flatness of each mounting seat surface can be ensured without performing any machining. FIG. 7(B) shows an example in which the support plate 17 is inclined in the vertical direction, wherein the inclination and the space S are enlarged for the purpose of facilitating the understanding thereof. The third embodiment is the same as the first embodiment except for the space S, and the components of the third embodiment same as those of the first embodiment are given the same reference numerals.

Figure 8:
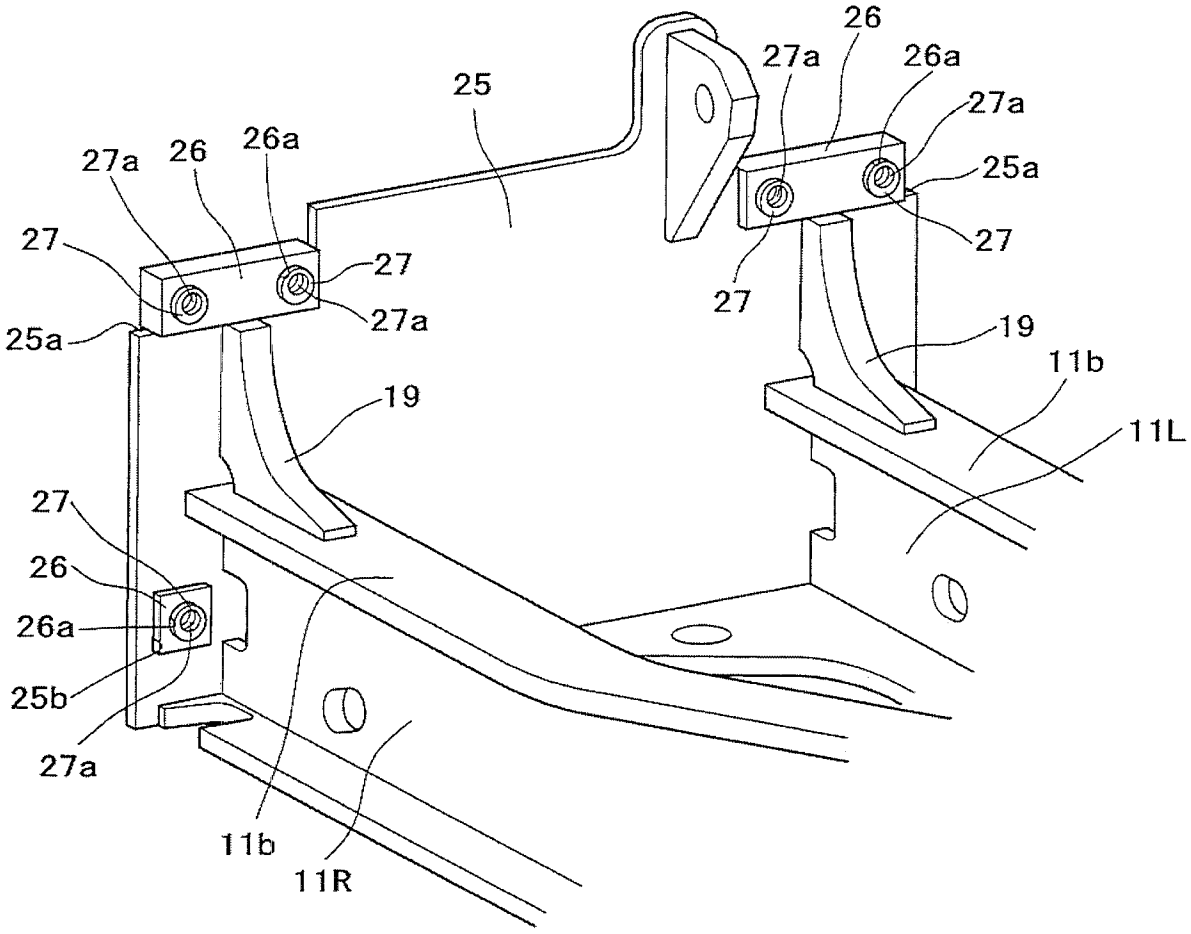
FIG. 8 is a perspective view of a counterweight support according to a fourth embodiment.
Figure 9:
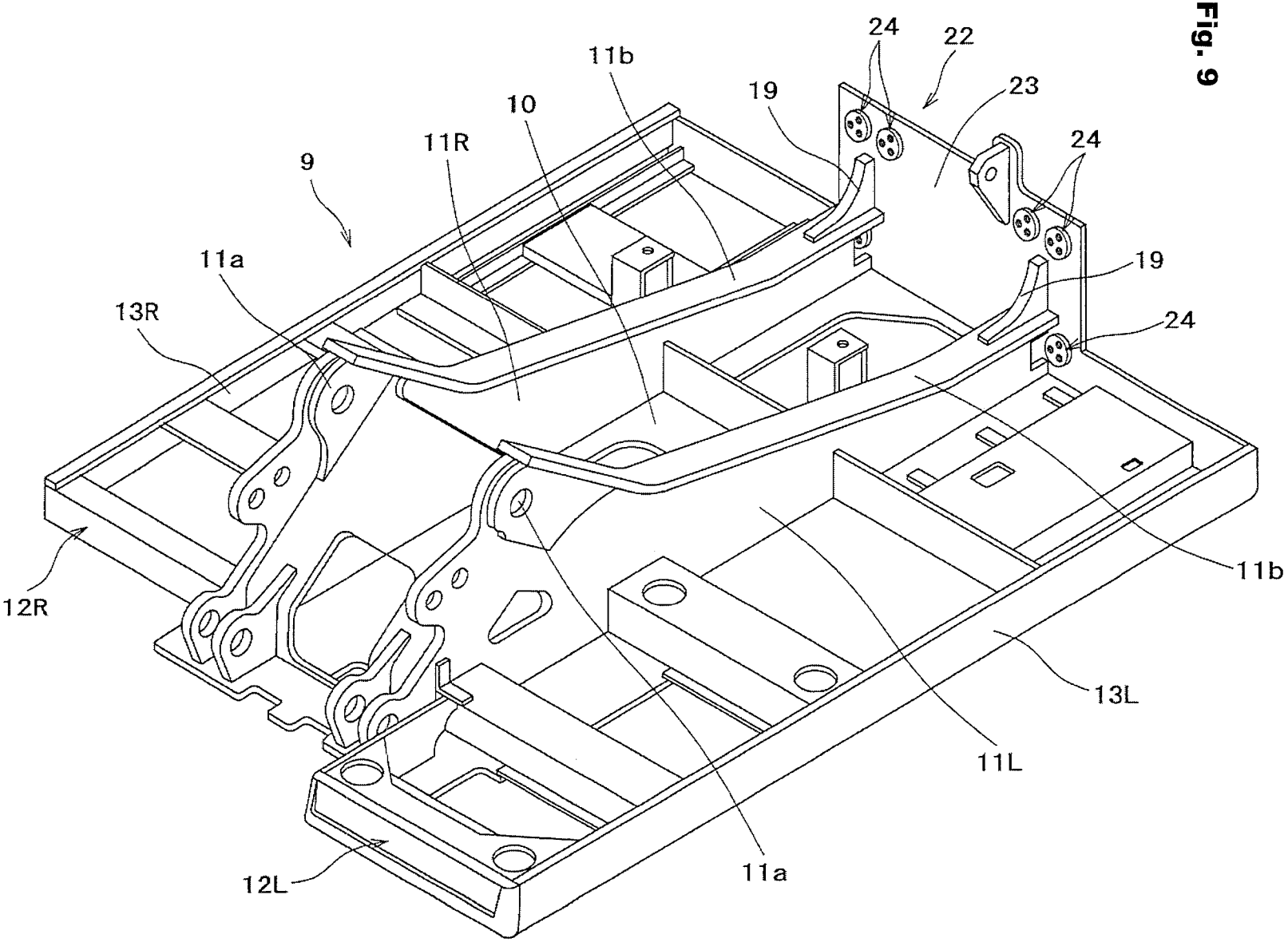
FIG. 9 is a perspective view of a slewing frame according to a fifth embodiment.
Figure 10:
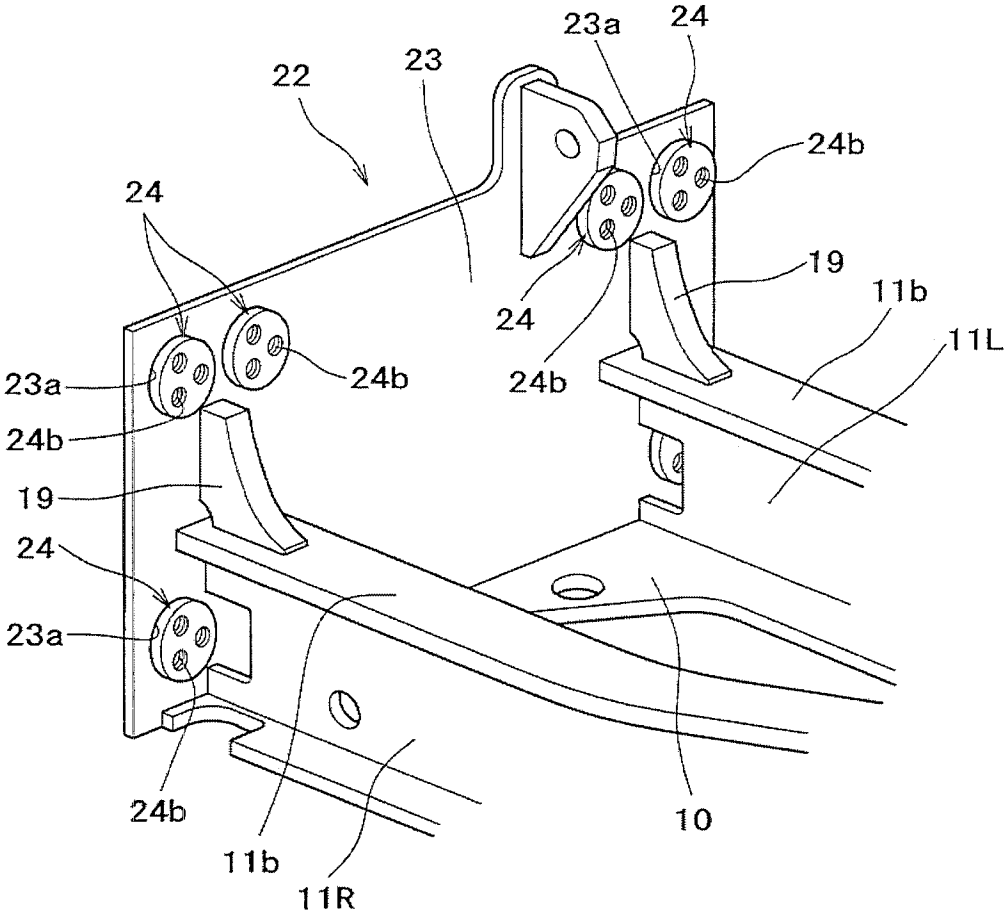
FIG. 10 is a perspective view of a counterweight support according to the fifth embodiment, viewed from the front.
Figure 11:
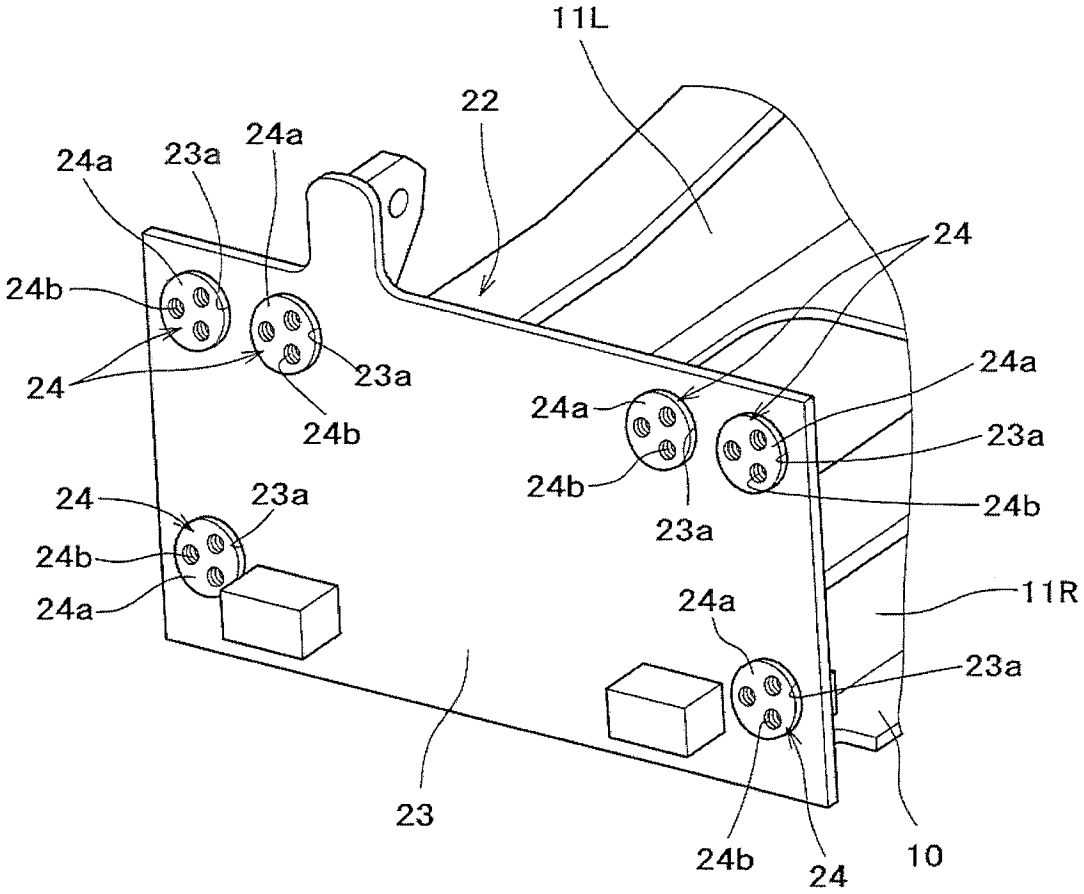
FIG. 11 is a perspective view of the counterweight support according to the fifth embodiment, viewed from the rear.
Figure 12:
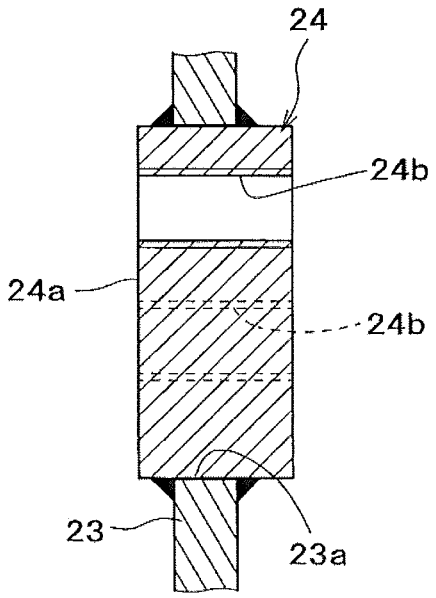
FIG. 12(A) is a cross-sectional view showing substantial portions of the counterweight support according to the fifth embodiment, and FIG. 12(B) a cross-sectional view showing the counterweight support to which is attached a counterweight according to the fifth embodiment.
Figure 12:
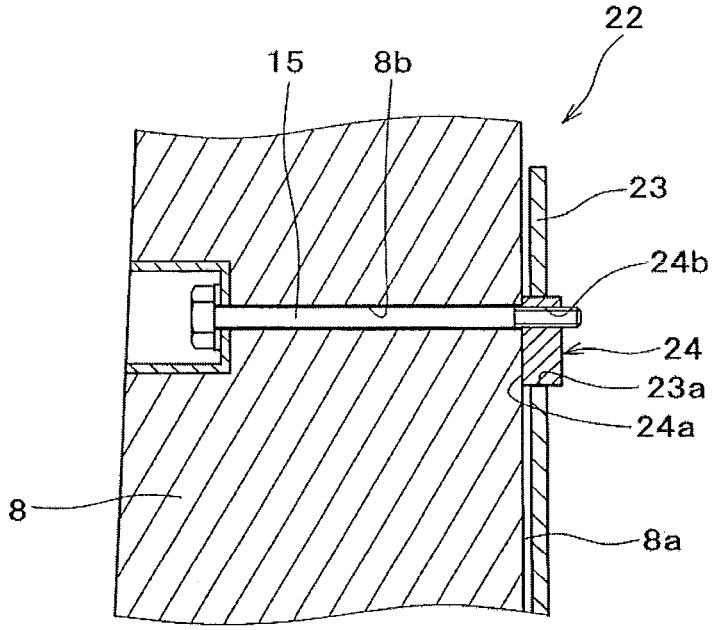
Figure 13:
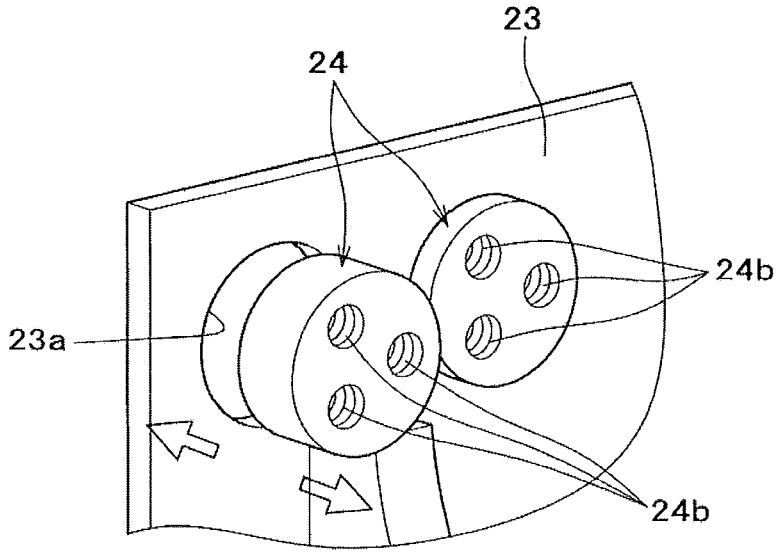
FIGS. 13(A) and 13(B) are each a diagram showing how a bolt fastening boss according to the fifth embodiment is attached.
Figure 13:
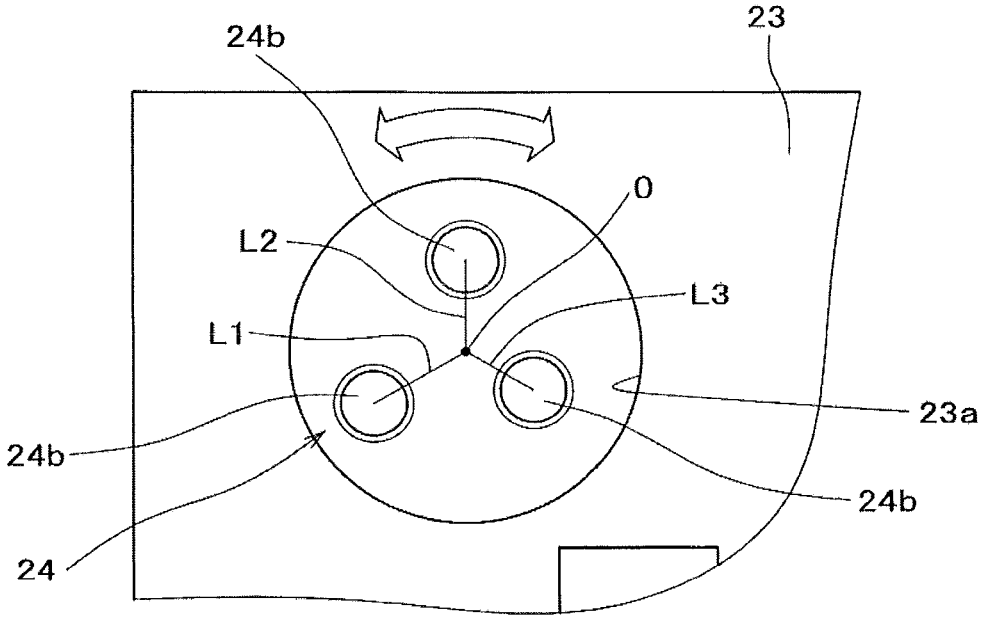

According to the configurations of the first to third embodiments, in order to attach the base members to the support plate, the base members are fitted and fixed to the through-holes opened in the support plate. However, the first to third embodiments are not limited to this configuration in which the through-holes are opened in the support plate. For instance, in a fourth embodiment shown in FIG. 8, depressions 25*a* are cut out on the upper left and the upper right of a support plate 25, so that base members 26 can be fixed to the depressions 25*a* in such a manner that the longitudinal positions and the lateral positions of the base members 26 are adjustable. Note that through-holes 25*b* same as those of the first embodiment are formed at the lower left portion and the lower right portion of the support plate 25, and the base members 26 are attached to the through-holes 25*b* in the same manner as in the first embodiment. The components shown in FIG. 8 that are the same as those of the first embodiment are given the same reference numerals. Also, in FIG. 8, reference numeral 27 represents bolt fastening bosses that are fitted and fixed to boss holes 26*a* opened in the respective base members 26, in such a manner that the rotation positions of the bolt fastening bosses are adjustable, and reference numeral 27*a* represents fastener holes formed in the respective bolt fastening bosses 27. In addition, according to the fourth embodiment, as in the third embodiment, the perpendicularity of the base members 26 with respect to the horizontal reference of the machine body can be ensured by adjusting the inclination of the base members 26 with respect to the support plate 25.

A fifth embodiment of the present invention is described next with reference to FIGS. 9 to 13. According to the fifth embodiment, as with the first embodiment, the rear portion of the slewing frame 9 configuring the base of the upper slewing body 4 of the hydraulic shovel 1 is provided with a counterweight support 22 for supporting the counterweight 8 through the fastening bolts 15. Note that the components of the fifth embodiment same as those of the first embodiment are given the same reference numerals, and the detailed descriptions thereof are omitted accordingly.

The counterweight support 22 is configured using a support plate 23 that is fixed upright to the rear portion of the slewing frame 9, and support members 24, described hereinafter, which are attached to the support plate 23 and comes into abutment with the front surface 8*a* of the counterweight 8 and to which the fastening bolts 15 are fastened.

As with the support plate 17 of the first embodiment, the support plate 23 is one of the frame materials configuring the slewing frame 9 and is integrally fixed by welding to the rear end portions of the left and right main frames 11L, 11R and of the bottom surface plate 10, with the surface of the support plate 23 being oriented vertically so as to face the front surface 8*a* of the counterweight 8 supported by the counterweight support 22. A plurality of (six, in the present embodiment) circular boss holes 23*a* are opened at the upper left portion, the upper right portion, the lower left portion, and the lower right portion, of the support plate 23 of the fifth embodiment. The support members 24 are attached to these boss holes 23*a*.

The support members 24, on the other hand, are attached to the support plate 23 fixed to the slewing frame 9, after the assembly of the slewing frame 9, and are each configured using a bolt fastening boss 24, described hereinafter, which has a counterweight mounting seat surface 24*a* and a fastener hole (screw hole) 24*b*. In the fifth embodiment, the support members 24 are each configured only with the bolt fastening boss 24. In other words, the bolt fastening bosses 24 themselves are the support members 24; thus, these components share the same reference numeral.

The bolt fastening bosses 24 are in the shape of a cylindrical block and fitted to the respective circular boss holes 23*a* opened in the support plate 23, in such a manner that the bolt fastening bosses 24 can be moved in the longitudinal direction and that the rotation positions of the same are adjustable. The thickness of each bolt fastening boss 24 in the longitudinal direction is set to be greater than the thickness of the support plate 23 in the longitudinal direction and the bolt fastening bosses 24 can be moved in the longitudinal direction by the difference between the thicknesses excluding the weld leg length. Furthermore, the bolt fastening bosses 24 are fitted into the boss holes 23*a* in such a manner that the rear surfaces of the bolt fastening bosses 24 (the surfaces facing the front surface 8*a* of the counterweight 8) project farther than the rear surface of the support plate 23, wherein the rear surfaces of the bolt fastening bosses 24 configure the counterweight mounting seat surfaces 24*a*, with which the front surface 8*a* of the counterweight 8 comes into surface-contact. Moreover, a plurality of (three, in the present embodiment) the fastener holes 24*b* are punched in each of the bolt fastening bosses 24. These fastener holes 24*b* are formed at the positions in each bolt fastening boss 24 that are off from the axial center position O, and the eccentric distances L1, L2, L3 from the axial central position O are set at mutually different values. The vertical and lateral positions of the plurality of fastener holes 24*b* can be changed by rotating the corresponding bolt fastening boss 24 about the axial center.

In order to attach the bolt fastening bosses 24 to the support plate 23, the bolt fastening bosses 24 are fitted into the boss holes 23*a* of the support plate 23, and in this state the bolt fastening bosses 24 are moved in the longitudinal direction to adjust the longitudinal positions of the counterweight mounting seat surfaces 24*a* to predetermined regular positions. Furthermore, the vertical and lateral positions of the plurality of fastener holes 24*b* punched in each bolt fastening boss 24 are changed by rotating each bolt fastening boss 24 about the axial center, and a fastener hole 24*b* located in the predetermined regular position (or the position closest to the regular position) is selected. Then, the bolt fastening bosses 24 that have their longitudinal positions and rotation positions adjusted are fixed by welding to the boss holes 23*a* of the support plate 23.

Then, after assembling the slewing frame 9, the counterweight support 22 is formed by fixing the bolt fastening bosses 24 to the support plate 23 configuring the slewing frame 9. In this case, the longitudinal positions of the counterweight mounting seat surfaces 24*a* can be positioned to the regular positions by adjusting the longitudinal positions of the bolt fastening bosses 24. Moreover, by adjusting the rotation positions of the bolt fastening bosses 24 and selecting fastener holes 24*b*, the vertical and lateral positions of the selected fastener holes 24*b* can be positioned to the regular positions.

On the other hand, the bolt insertion holes 8*b* are formed in the counterweight 8, as in the first embodiment. With the front surface 8*a* of the counterweight 8 in surface-contact with the counterweight mounting seat surfaces 24*a* of the bolt fastening bosses 24, the fastening bolts 15, which are inserted into the bolt insertion holes 8*b* from the rear side of the counterweight 8, are threaded and fastened to the selected fastener holes 24*b* of the bolt fastening bosses 24, thereby causing the counterweight support 22 to support the counterweight 8. In this case, the positions of the counterweight mounting seat surfaces 24*a* and the fastener holes 24*b* are adjusted to the regular positions as described above, so that the counterweight 8 can be attached to the regular position.

According to the fifth embodiment configured as described above, as with the first embodiment, the counterweight support 22 is configured using the support plate 23 fixed upright to the rear portion of the slewing frame 9, and the support members 24 that are attached to the support plate 23 fixed to the slewing frame 9 and have the counterweight mounting seat surfaces 24*a* coming into abutment with the counterweight 8 and the fastener holes 24*b* to which the fastening bolts 15 are fastened. The support members 24 of the fifth embodiment are configured using the cylindrical bolt fastening bosses 24 with the counterweight mounting seat surfaces 24*a*, which are fitted and fixed to the circular boss holes 23*a* opened in the support plate 23, in such a manner that the longitudinal positions and the rotation positions of the bolt fastening bosses 24 are adjustable. The plurality of fastener holes 24*b*, the eccentric distances L1, L2, L3 from which to the axial center position O are mutually different, are formed in the bolt fastening bosses 24.

According to the fifth embodiment configured as described above, the longitudinal positions of the counterweight mounting seat surfaces 24*a* can be adjusted by adjusting the longitudinal positions of the bolt fastening bosses 24, and the vertical and lateral positions of the fastener holes 24*b* can be adjusted by adjusting the rotation positions of the bolt fastening bosses 24 and selecting the fastener holes 24*b*, significantly improving the positional accuracy of the counterweight mounting seat surfaces 24*a* and of the fastener holes 24*b*. Consequently, the work on attaching the counterweight 8 can be performed accurately. In addition, the configuration of the fifth embodiment is advantageous in having a low number of parts and therefore a simple structure because the support members 24 are configured only with the bolt fastening bosses 24.

Figure 14:
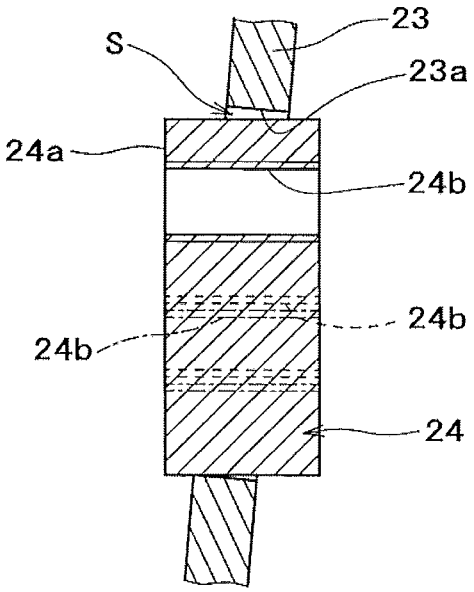
FIG. 14 is a cross-sectional diagram showing how a bolt fastening boss according to a sixth embodiment is attached.

According to a sixth embodiment shown in FIG. 14, the bolt fastening bosses 24 of the same structure as those of the fifth embodiment are used, and a space S for adjusting the inclination of each bolt fastening boss 24 with respect to the support plate 23 is formed between the corresponding boss hole 23*a* opened in the support plate 23 and the bolt fastening boss 24 fitted into the boss hole 23*a*, prior to fixing the bolt fastening boss 24 to the support plate 23. While having the longitudinal position and the rotation position of the bolt fastening boss 24 adjusted similarly to the fifth embodiment and having the inclination of the bolt fastening boss 24 adjusted in such a manner that the counterweight mounting seat surface 24*a* thereof becomes parallel to the front surface 8*a* of the counterweight 8 at the regular position, the bolt fastening boss 24 is fixed to the support plate 23 by welding, and thereby the space S is filled as a result of this welding. By fitting and fixing the bolt fastening boss 24 to the corresponding boss hole 23*a* opened in the support plate 23 in such a manner that the inclination of the bolt fastening boss 24 with respect to the support plate 23 is adjustable, the inclination of the bolt fastening boss 24 can be adjusted in such a manner that the counterweight mounting seat surface 24*a* thereof becomes parallel to the front surface 8*a* of the counterweight 8 at the regular position, even when the support plate 23 is fixed to the slewing frame 9 while being inclined in the longitudinal, vertical, and lateral directions due to welding stress or the like, as in the third embodiment described above. Thus, the perpendicularity of the bolt fastening boss 24 with respect to the horizontal reference of the machine body can be ensured. Note that FIG. 14 shows an example in which the support plate 23 is inclined in the vertical direction, wherein the inclination and the space S are enlarged for the purpose of facilitating the understanding thereof.

INDUSTRIAL APPLICABILITY

The present invention can be utilized in order to attach a counterweight for ensuring the balance of the machine body in a construction machine such as a hydraulic shovel.

The invention claimed is:

1. A counterweight supporting structure for a construction machine having a counterweight and a vehicle body frame, the counterweight supporting structure comprising:

a support plate fixed upright along a vertical direction to a rear portion of the vehicle body frame, a thickness of the support plate extending from a first face of the support plate to a second face of the support plate along a longitudinal direction, the longitudinal direction being perpendicular to the vertical direction;

a base member attached to the support plate, a thickness of the base member extending from a first face of the base member to a second face of the base member along the longitudinal direction, the first face of the base member and the first face of the support plate each facing the counterweight; and a cylindrical bolt fastening boss defining a fastener hole extending through a length of the cylindrical bolt fastening boss along the longitudinal direction, an axis of the fastener hole being offset from a central axis that is centered on a cylindrical outer surface of the cylindrical bolt fastening boss, the length of the cylindrical bolt fastening boss at least partially overlapping with the thickness of the base member along the longitudinal direction, the thickness of the base member at least partially overlapping with the thickness of the support plate along the longitudinal direction, such that a periphery of the base member directly faces the thickness of the support plate, the first face of the base member extending beyond the first face of the support plate along the longitudinal direction and disposed in abutment with the counterweight, at least a portion of the periphery of the base member being welded to at least one of the first face of the support plate and the second face of the support plate.

2. The counterweight supporting structure for the construction machine according to claim 1, wherein the base member defines a circular boss hole extending through the thickness of the base member, the cylindrical bolt fastening boss is disposed within the circular boss hole, and the cylindrical bolt fastening boss is welded to the base member.

3. The counterweight supporting structure for the construction machine according to claim 2, wherein the first face of the base member is inclined relative to the first face of the support plate.

4. The counterweight supporting structure for the construction machine according to claim 2, wherein the cylindrical bolt fastening boss defines a plurality of fastener holes through the length of the cylindrical bolt fastening boss, the fastener hole being a first fastener hole of the plurality of fastener holes, an axis of each fastener hole of the plurality of fastener holes being offset from the central axis of the cylindrical bolt fastening boss, a radial distance from the axis of each fastener hole to the central axis being different from a radial distance from the axis of any other fastener hole of the plurality of fastener holes to the central axis.

5. The counterweight supporting structure for the construction machine according to claim 4, wherein a longitudinal axis of the cylindrical bolt fastening boss is inclined relative to a longitudinal axis of the circular boss hole through the base member.

6. The counterweight supporting structure for the construction machine according to claim 1, wherein the length of the cylindrical bolt fastening boss extends from a first face of the cylindrical bolt fastening boss to a second face of the cylindrical bolt fastening boss along the longitudinal direction, the first face of the cylindrical bolt fastening boss facing the counterweight, and the first face of the base member extends beyond the first face of the cylindrical bolt fastening boss along the longitudinal direction.

7. The counterweight supporting structure for the construction machine according to claim 6, wherein the cylindrical bolt fastening boss is welded to the base member.

8. The counterweight supporting structure for the construction machine according to claim 1, further comprising a fastening bolt extending at least partially through the counterweight and at least partially through the fastener hole of the cylindrical bolt fastening boss.

9. The counterweight supporting structure for the construction machine according to claim 1, wherein an internal surface of the support plate defines a hole therethrough, and the base member is disposed within the hole of the support plate, such that the periphery of the base member directly faces the internal surface of the support plate.

* * * * *